United States Patent [19]

Contreras, Sr.

[11] Patent Number: 4,863,034

[45] Date of Patent: Sep. 5, 1989

[54] COMPACT WITH REMOVABLE AND REPLACEABLE STORAGE TRAY

[76] Inventor: Joseph P. Contreras, Sr., 6 Brockden Dr., Mendham, N.J. 07945

[21] Appl. No.: 777,517

[22] Filed: Sep. 19, 1985

[51] Int. Cl.[4] ..... A45C 11/00; B65D 25/02

[52] U.S. Cl. ..... 206/581; 132/294; 206/561; 206/37; 220/410

[58] Field of Search ..... 206/581, 229, 235, 514, 206/501, 561, 562, 563, 37; 132/83 G, 83 B, 82 R, 294; 220/410

[56] References Cited

U.S. PATENT DOCUMENTS

| | | | |
|---|---|---|---|
| 680,658 | 8/1901 | Hastings | 206/1.8 |
| 1,642,611 | 9/1927 | Kendal | 132/82 R |
| 1,643,944 | 10/1927 | Cook | 132/82 R |
| 1,647,917 | 11/1927 | Kendall | 132/82 R |
| 1,664,301 | 3/1928 | Kendall | 132/82 R |
| 1,686,973 | 10/1928 | Kendall | 132/82 R |
| 1,694,325 | 12/1928 | Kendall | 132/82 R |
| 2,866,467 | 12/1958 | Bradford | 132/82 R |
| 2,990,054 | 6/1921 | Gellman | 220/411 |
| 3,592,201 | 7/1971 | Haddaway | 220/306 |
| 3,742,965 | 7/1973 | Hudziak | 220/410 |
| 4,136,306 | 1/1979 | Margolin | 206/37 |
| 4,421,127 | 12/1983 | Geer | 206/37 |
| 4,526,273 | 7/1985 | Tsuji et al. | 206/229 |
| 4,538,725 | 9/1985 | Glover et al. | 206/37 |

*Primary Examiner*—Stephen Marcus

*Attorney, Agent, or Firm*—Lerner, David, Littenberg, Krumholz & Mentlik

[57] ABSTRACT

A container for powder, cosmetics and other materials has a base member having an interior wall defining a sized and shaped storage tray receptacle, a closure member pivotally connected to the base member is movable from open to closed position and vice versa. A sized and shaped storage tray is disposed to fit into the storage tray receptacle in the base member, and at least one retainer assembly formed on the storage tray and wall means of the base member including, a manually operable yieldable section to enable the storage tray to be removable fixed in assembled position in the base member. The container as above described including spaced compartments in the storage tray for powder, cosmetics and other materials and an applicator for use therewith.

8 Claims, 2 Drawing Sheets

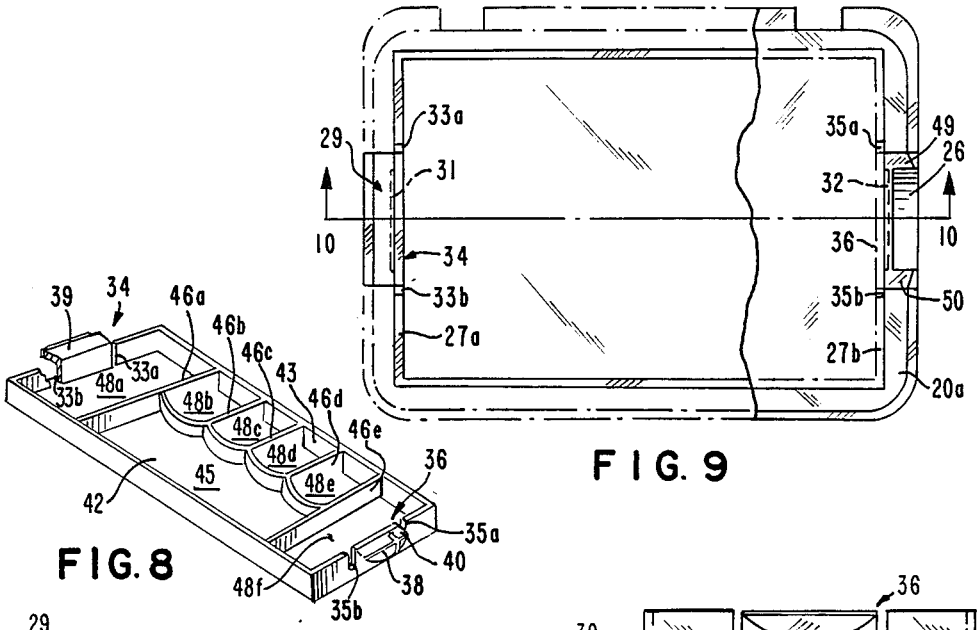
FIG. 9
FIG. 8
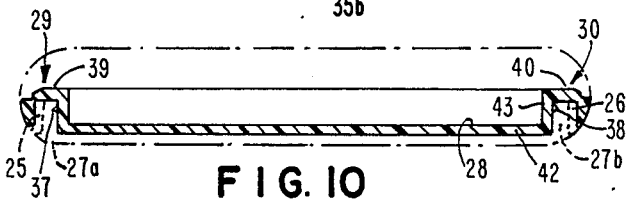
FIG. 10
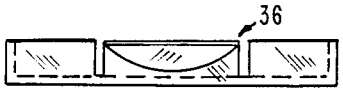
FIG. 12
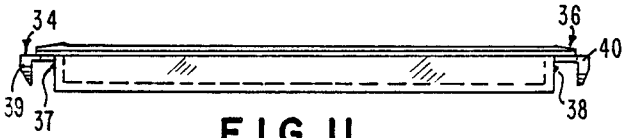
FIG. 11
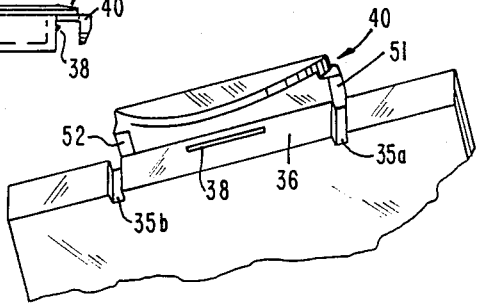
FIG. 14
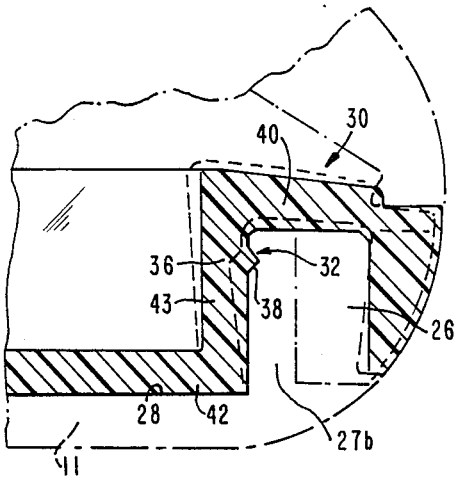
FIG. 13

COMPACT WITH REMOVABLE AND REPLACEABLE STORAGE TRAY

BACKGROUND OF THE INVENTION

This invention relates generally to containers and compacts and more particularly to a makeup container or compact with a removable storage tray for cosmetics, powders and the like material and the associated applicator.

The cosmetic industry for many years has sought to develop a makeup container or compact which is adapted to receive a removable and replaceable storage section for various types of cosmetics, powders and the like.

This was due in part to the wasteful prior art type of makeup container and compacts which had to be discarded after the cosmetics contained therein were used up or became unusable for various reasons. These prior art containers which had to be discarded had in many instances outer containers which were expensive.

Additionally, because of the wide variety of cosmetics that were used and the variations in colorations for example in eye shadows which either were in vogue or which varied depending on the time of the day that such eye shadow was used made it necessary for the manufacturer to provide a whole series of makeup containers or compacts each containing various types of colors which required a substantial inventory in order to meet the needs of the purchasing public.

Since the manufacture of the products preceded the placing of these products on the market, the problem of selecting colors which would be popular for a given cosmetic required some "crystal-ball guessing" on the part of the manufacturer which if wrong could result in a substantial losses of sales due to the lack of demand for the manufacturer's quantity of warehoused makeup containers or compacts in the wrong color.

The outer casing for makeup containers and compacts constitutes the major cost in their manufacturer. Therefore, manufacturers of these makeup containers and compacts for the cosmetic industry have sought to develop units in which a single outer casing for a makeup container or compact can be so utilized that a plurality of varying storage inserts can be connected therein in accordance with the needs of the ultimate consumer.

In an effort to meet these problems the manufacturers of makeup containers and cosmetics have from time to time developed makeup containers or compacts with outer containers of relatively expensive construction which are adapted to receive inserts containing the cosmetic materials thus permitting the marketing representative for the manufacturer to keep a smaller number of outer casings and an inventory of makeup inserts having a wide variety of colors which can be selected by the ultimate consumers.

Thus, in U.S. Pat. No. 4,132,306 a makeup container construction is shown having an outer container with spaced recess portions into which one or more of a variety of makeup inserts made of a sufficiently resilient material and provided with extended tapered lugs thereon can be aligned with the groove in the outer casing so that the makeup insert or inserts can be snap fitted into position.

This makeup container construction while meeting the need for permitting selection of the desired color does not overcome the economic waste which occurred with the prior art devices because this construction also had to be discarded when the cosmetic was used up because the makeup insert or inserts could not be removed once the makeup insert was snap fitted into assembled position.

Other efforts to meet this conjoint problem of easily available selectivity and of overcoming the problems of discarding the more expensive outer casing are illustrated by U.S. Pat. Nos. 1,642,611; 1,643,944; 1,647,917; 1,664,301 and 1,686,973 in which the insert with the cosmetic material can be removably fixed in the expensive outer casing and then by ejector means operatively associated therewith can be actuated to enable the insert containing the cosmetic when used up or rendered nonusable to be removed and replaced by another insert of similar shape and form containing fresh cosmetics therein.

U.S. Pat. No. 2,866,467 shows a makeup insert which can be inserted through an opening in the bottom of the outer casing having resilient projections which yield during the inserting movement and then engage in a suitable groove in the makeup insert to hold the same in assembled position until the makeup or cosmetic in the insert is used up at which time the insert can be pried loose and replaced with a new insert.

U.S. Pat. Nos. 1,694,325 and 3,592,201 show compacts or makeup containers in which projection either on the outer casing or on the makeup insert coact with grooved sections to permit the insert to be forced into assembled position.

A similar problem to that of the cosmetic industry has been met in the arts and crafts industry for the construction of color boxes where a frame for holding various inserts is held by spaced projections on the storage frame for the inserts which coact with grooves in the coloring box casing as is shown in U.S. Pat. No. 680,658.

The present invention provides an improved makeup container or compact for cosmetics and other material for overcoming these problems of the prior art by providing in the base member of the outer casing a receptacle for a removable storage tray sized and shaped to fit therein which has a retaining assembly consisting of at least one resilient coacting clasp means on the side thereof disposed in fitted resilient or assembled position in the receptacle to engage an aligned groove in the wall of the base member to hold the removable storage tray in assembled position, the coacting clasp has an actuator which can be manually operated to release and remove the storage tray from the receptacle in the base member of the makeup container or compact. This clasp means enables the user to replace the used storage tray with a new removable storage tray as may be required, thus permitting a single outer casing for a makeup container or compact to be utilized with a plurality of removable and replaceable storage trays having the desired makeup or cosmetics therein.

SUMMARY AND OBJECTS OF THE INVENTION

Thus the present invention covers an improved container for powders, cosmetics and other materials comprising, a base member having, inner wall means defining a sized and shaped receptacle, a closure member pivotally connected to the base member for movement from open to closed position, a removable storage tray sized and shaped to fit into the receptacle in the base member, and a retainer assembly operatively associated with the base member and the removable storage tray to removably fix the storage tray in assembled position in the base member.

Additionally, the container as above described including, spaced compartments connectible in the removable storage tray for powder, cosmetics and other material, and the applicator therefor.

Accordingly, it is an object of the present invention to provide a container such as a makeup container or a compact having an outer casing defining a receptacle therein adapted to receive a wide variety of removable and replaceable storage trays or cosmetic inserts.

It is another object of the present invention to provide an improved container, compact and the like which will permit the marketing retailer to maintain a relatively small inventory of outer casings and a large inventory of removable storage trays each having a variety of the relatively low cost cosmetics in varying colors for use therein, and for reorder and replacement as may be required by the user.

It is a still further object of the present invention to provide an improved container, compact and the like having an outer casing defining a receptacle therein adapted to receive a wide variety of removable and replaceable storage trays wherein the storage trays and inner wall means in the outer casing have a coacting resilient retainer assembly means which can be manually operated to enable the various storage trays to be selectively and alternatively inserted, removed and replaced as may be required by the user.

The above and other objects of the present invention will become apparent from the description of a preferred embodiment in accordance with the present invention described in conjunction with the accompanying drawings in which:

BRIEF DESCRIPTION OF THE DRAWINGS

FIG. 8 is a perspective view of the removable and replaceable storage tray for the compact shown in FIG. 1.

FIG. 9 is a top plan view of the removable and replaceable storage tray showing the base member partly in phantomized form and broken away to show the base member in solid lines and the removable storage tray in phantomized line.

FIG. 10 is a cross section taken along line 10—10 of FIG. 9 with the base member and the cover member shown in phantomized lines.

FIG. 11 is a front view of the storage tray shown in FIGS. 8 and 9.

FIG. 12 is a right side view of the storage tray shown in FIGS. 8 and 9.

FIG. 13 is a fragmentary cross-section of the clasp section on the storage tray shown in FIGS. 8 to 12.

FIG. 14 is a partial perspective view of the underside of the clasp element on the storage tray shown in FIGS. 8 to 13.

DESCRIPTION OF A PREFERRED EMBODIMENT

Figure 1:
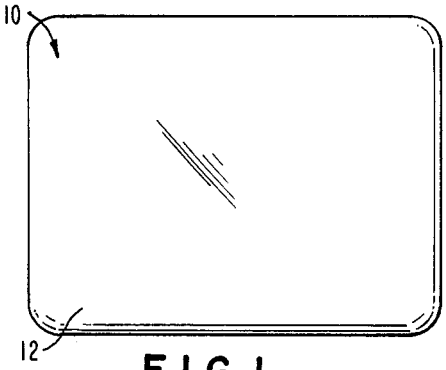
FIG. 1 is a top plan view of a compact for cosmetics in accordance with the present invention.
Figure 2:
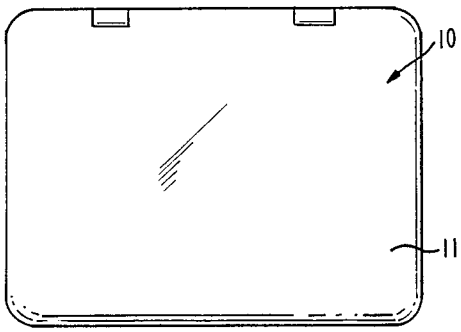
FIG. 2 is a bottom plan view of the compact shown in FIG. 1.
Figure 3:
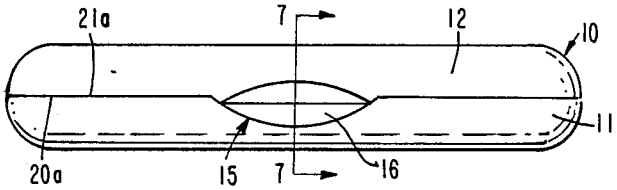
FIG. 3 is a front view of the compact shown in FIG. 1.
Figure 5:
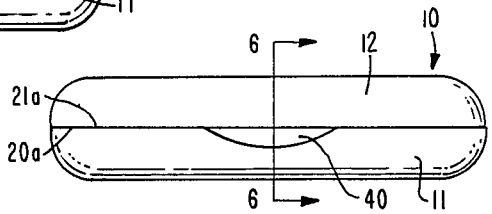
FIG. 5 is a right side view of the compact shown in FIG. 1.
Figure 4:
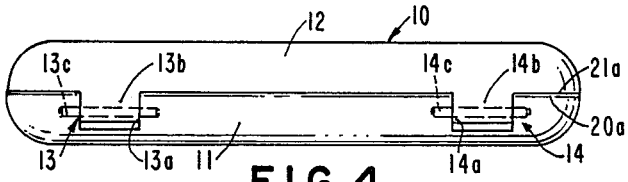
FIG. 4 is a rear view of the compact shown in FIG. 1.

The FIGURES of the drawings show a compact generally designated 10 in accordance with the present invention. Compact 10 is provided with a base 11 and a mating cover or closure member 12 which is pivotally connected to the base member as by spaced hinges generally designated 13 and 14 to permit the cover member to be moved or pivoted from closed to open position and vice versa relative the base member.

A latch generally designated 15 formed on the base 11 and cover 12 at a point generally opposite from the hinges 13 and 14 provides means for locking and holding the cover 12 in the closed position on the base member 11 as is shown in FIGS. 1 to 4 of the drawings. A fingertip groove or space 16 in the base member 11 enables the user of the compact 10 to exert manual pressure for releasing the cover 12 from the locked or engaged position so it can be moved or pivoted to the freely open position.

Base 11 and cover 12 are preferably molded from plastic material such as polypropylene, acrylonitrile-butadiene styrene (ABS) and polycarbonate to provide the proper finish and appearance required to aid the marketability of these compacts in connection with the removable and replaceable storage tray generally designated 17 which is operatively or removably connected into the base 11 to accomplish the objects and purposes of the present invention as is more fully described below.

Further while the preferred form of compact in accordance with the present invention is illustrated in rectangular forms those skilled in the art will readily recognize that the compact can be square, oval, round or even irregular in shape without departing from the scope of the present invention.

Base 11 has a peripheral edge as at 20 which is generally continuous except for the spaced indented flange sections as at **13*a* and 14*a*. Associated hinge members 13*b* and 14*b* on the cover member 12 are so fitted into the idented hinge section that suitable hinge pins as at 13*c* and 14*c* can be disposed across the indented section and in engagement with the hinge members 13*b* and 14*b* to form the hinge to permit the cover to be pivoted relative the base 11** when mounted in this assembled position thereon.

FIGS. 1 to 7 further show that the cover member 12 is sized and shaped to fit and engage the base member 11 and like the base member is provided with a peripheral edge as at 21. The respective upper surface **20*a* of the base member defines a first sealing face and the lower surface 21*a* of the peripheral edge 21 on the cover member provides a second sealing surface which will coact with each other to provide sealing engagement when the cover member is pivoted to the closed or engaged position relative the base 11**.

The cover member is provided with an annular wall 22 which defines a mirror receptacle in which a conventional mirror 24 is mounted or adhesively connected as is well known to those skilled in the art.

The base member 11 will also be provided on each respective side thereof with slots or spaces as at 25 and 26 for purposes that will appear clear hereinafter in connection with the description of the retainer means for removably connecting the storage tray 17 into assembled position in the base 11.

Thus, inwardly of the peripheral edge 20 on the base member the inner wall 27 defines a sized and shaped storage tray receptacle 28 into which the correspondingly sized and shaped storage tray 17 may be snugly fitted by snapping the same into assembled position in the receptacle by means of a pair of oppositely spaced retainer assemblies as at 29 and 30 as is clearly shown in FIGS. 6, and 8 to 14 of the drawings; now to be described.

RETAINER ASSEMBLIES

Figure 6:
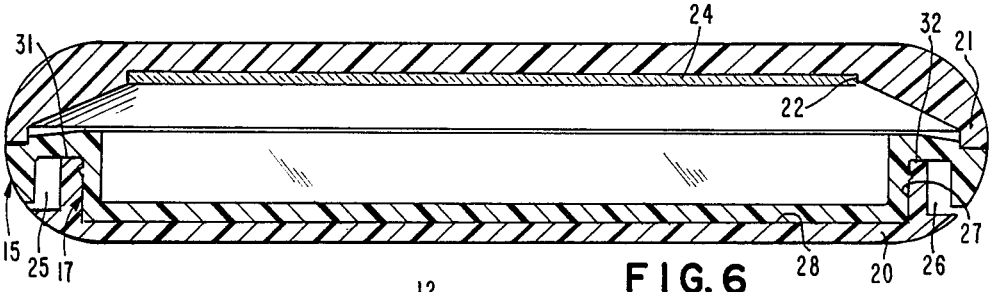
FIG. 6 is a cross section taken along line 6—6 of FIG. 5.
Figure 7:
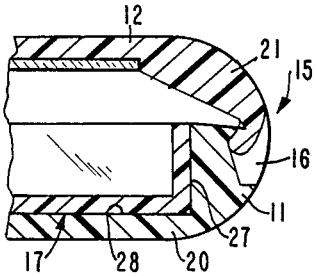
FIG. 7 is a fragmentary cross section taken along line 7—7 of FIG. 3.

FIGS. 6, 9 and 13 show that the inner face of the inner wall 27 in the base member 11 defining the storage tray receptacle 28 has in each of the oppositely spaced side walls 27*a* and 27*b* thereof indentation as at 31 and 32, each respectively disposed in the medial section of the associated side wall in general alignment with the side slots or spaces 25 and 26.

The removable and replaceable storage tray member 17 is provided in the respective oppositely spaced side walls with spaced slots as at 33*a* and 33*b* to define a first yieldable or movable member 34 and spaced slots 35*a* and 35*b* to define a second yieldable or movable member 36. Continuous with each of the yieldable or movable members 34 and 36 are outwardly extending lateral projections as at 37 and 38 which are in a predetermined position such that when the storage tray 17 is pressed into position in the storage tray receptacle 28 formed in the base member 11 the yieldable or movable section 34 and 36 can be distorted sufficiently by there lateral projections 37 and 38 to permit the lateral projections 37 and 38 to enter the storage tray receptacle 28 until they are aligned and brought into engagement with the spaced indentations 31 and 32 in the side faces of the inner wall 27 in the base member thus acting to hold or lock the given storage tray being inserted into assembled position in the base member of compact 10 all of which is clearly shown in FIGS. 6, 9 and 10 to 14 of the drawings.

FIGS. 6, 9 and 10 to 14 further show that continuous with the respective upper surfaces of the yieldable or movable sections 34 and 36 are oppositely disposed or laterally extending L-shaped actuating members 39 and 40 so sized and shaped that when the storage tray 17 is in assembled position in the receptacle 28 formed in base 11, the L-shaped actuating members 39 and 40 will lie in the oppositely spaced side slots or spaces 25 and 26 in the peripheral edge 20 of the base 11. Thus, when the compact 10 is in the open position the L-shaped actuating members 33 and 34 can be accessed for the application of manual pressure from opposite directions to force the yieldable members 34 and 36 inwardly thus causing the lateral projections 37 and 38 on the outer face of the yieldable sections to disengage from the indentation 31 and 32 in the side walls 27*a* and 27*b* of the inner wall 27 defining the storage tray receptacle 28 in the base 11. When the lateral projections 37 and 38 are so disengaged, the storage tray 17 can be separated from the storage tray receptacle 28 and removed from the compact 10.

A new storage tray or a replacement storage tray can now be fitted into the storage tray receptacle 28 by manually pressing the storage tray into position until the lateral projections 37 and 38 thereon engage the indentations 31 and 32 on the sides 27*a* and 27*b* of the wall 27 of the base 11.

The intermediate removable and replaceable storage tray 17 is provided with a bottom 42 and annular side wall 43 which define a storage space 45 divided by a plurality of transverse partitions as at 46*a*, 46*b*, 46*c*, 46*d* and 48*e* into compartments 48*a*, 48*b*, 48*c*, 48*d* 48*e* and 48*f*, for example, for storing a plurality of eyeshadow cosmetics of different shades for a given color, not shown, and an applicator, not shown, as is shown in FIG. 8 of the drawings.

Those skilled in the art will readily recognize that the transverse partitions can be readily varied in size and shape to adjust the size of the various compartments formed in the storage tray 17.

Reference is also made to the drawings which show that the slots or spaces 25 and 26 are beveled on opposite sides at 49 and 50 as shown in FIG. 9 for slot or space 26 and the associated opposite coacting sides of the L-shaped manual actuating members 39 and 40 are also beveled as at 51 and 52 for the L-shaped actuating member 40 in FIG. 14. This will permit yieldable or movable sections 34 and 36 and their associated L-shaped manual activating members 39 and 40 to fit into the slots 25 and 26 when a given storage tray 17 is snapped into assembled position in the base 11 of compact 10.

Those skilled in the art will recognize that while the preferred embodiment described is illustrated for eye shadow cosmetics that it may be used for other types of cosmetics such as powders or the like or other materials when it is necessary to maintain small quantities of such materials readily available for various purposes.

OPERATION

The compact 10 can be manually opened by exerting finger pressure in the finger groove 16 until the latch 15 is released from the engaged position. The cover 12 can now be pivoted to an open position. In the open position a storage tray insert member 17 filled with the desired cosmetics or other material is pressed into the storage tray receptacle space 28 in the base member until the lateral projections 37 and 38 engage the indentations 31 and 32 as above described to hold or fix the storage tray 17 in assembled position in the base member 11.

In this position the L-shaped actuating members 39 and 40 overlie the side slots or spaces 25 and 26 in the peripheral edge 20 of the base member 11 as is shown in FIGS. 6, 9 and 13 of the drawings.

The cover 12 is now pressed and latched in the closed position so that the lower peripheral edge 21*a* on the cover 12 and the upper peripheral edge 20*a* on the base 11 will engage and seal the compact until it is necessary to open the compact for access to the cosmetics or other materials therein in the storage tray 17.

When access to the cosmetics or other material in the spaced compartments is again desired manual pressure is applied to the finger groove 16 until the latch 15 disengages and the cover 12 is released and can be pivoted to open position for this purpose.

If it is desired to remove the storage tray 17, then when the compact is in the open position manual forces are exerted on the oppositely disposed L-shaped actuating members 39 and 40 until the oppositely disposed lateral projections 37 and 38 are released from engagement with the indentations 31 and 32. The tray can now be lifted out of the storage tray receptacle 28 and a new storage tray inserted in place thereof.

Thus an improved compact with a relatively simple removable and replaceable storage tray for makeup containers and compacts has been disclosed to provide great versatility for meeting and overcoming the commercial problems of the prior art which were not only wasteful, uneconomical but complicated the problems of the manufacturing and marketing of modern day makeup containers, compacts and the materials contained therein.

It will be understood that the invention is not to be limited to the specific construction or arrangement of parts shown but that they may be widely modified within the invention defined by the claims.

What is claimed is:

1. A container comprising, a. a base member having wall means therein defining a sized and shaped storage tray receptacle, b. a closure member pivotally connected to the base member and disposed to maintain the receptacle in the container normally closed and movable relative the base member from closed to open position and vice versa, c. storage tray means having, compartments, and sized and shaped to fit into the storage tray receptacle in the base member, and d. retainer assembly means including, at least one yieldable means on the storage tray operable for engagement with the base member to removably connect the storage tray in assembled position therein.

2. The container as claimed in claim 1 wherein, a. the wall means in the base member is provided with at least one indentation, b. the storage tray is provided with at least one yieldable side section, and c. said yieldable side section having a lateral projection thereon disposed for detachable engagement with the indentation on the wall means to removably fix the storage tray in assembled position in the storage tray receptacle of the base member.

3. The container as claimed in claim 1 wherein, a. said base member has, slot means in the peripheral edge thereof, b. said retainer assembly means includes, yieldable means on said storage tray, and manual actuating means for operating the yieldable means on said storage tray, and c. said actuating means disposed in the slot means when said storage tray is in assembled position in the compact.

4. The container as claimed in claim 3 wherein said retainer assembly includes, a. the wall means in the base member having at least one indentation, b. the storage tray having a pair of spaced slots to form at least one yieldable means thereon, c. said yieldable means having a lateral projection disposed in assembled position to engage the indentation for holding the storage tray in assembled position, and d. said indentation, said lateral projection and said slots in the periphery of the base means being disposed in substantial alignment with each other.

5. The container as claimed in claim 3 wherein, a. the base means includes beveled edges on opposite sides of said slot means, and b. the manual actuating means include mating beveled edges on opposite sides thereof to enable the actuating means to fit in snug engagement with the beveled edges on said base member.

6. The container as claimed in claim 1 wherein, a. said retainer assembly means includes yieldable means on said storage tray, and b. said storage tray having a pair of spaced transverse slots defining said yieldable means, and c. actuating means connected to said yieldable means for operating the yieldable means to permit the storage tray to be removed from assembled position.

7. The container as claimed in claim 1 wherein said retainer assembly means includes, a. the wall means in the base member having at least one indentation, b. the storage tray having a pair of spaced slots to form at least one yieldable means thereon, c. said yieldable means having a projection disposed in assembled position to engage the indentations for holding the storage tray in assembled position, and d. manual actuating means connected to said yieldable means and operable for moving said yieldable means to release the projection from engaged position to permit the storage tray to be removed from assembled position in the compact.

8. The container as claimed in claim 7 wherein, a. said at least one indentation is on the inner face of the wall means in the base member, and the projection is on the outer face of the yieldable means and disposed for alignment with the indentation in the wall means of the base member for facilitating assembly and removal of the storage tray from the compact.

* * * * *